US005609295A

United States Patent [19]

Richards

[11] Patent Number: 5,609,295

[45] Date of Patent: Mar. 11, 1997

[54] COMPOSITE RAILWAY TIE AND METHOD OF MANUFACTURE THEREOF

[75] Inventor: Denis C. Richards, Mississauga, Canada

[73] Assignee: Green Track Inc., Bolton, Canada

[21] Appl. No.: 368,903

[22] Filed: Jan. 5, 1995

[51] Int. Cl.[6] ..... E01B 3/36

[52] U.S. Cl. ..... 238/84; 238/85; 238/106

[58] Field of Search ..... 238/84, 85, 106; 248/346.01; 106/714, 738, 817

[56] References Cited

U.S. PATENT DOCUMENTS

| | | | |
|---|---|---|---|
| 1,616,266 | 2/1927 | Lacey | 238/106 |
| 3,813,040 | 5/1974 | Heinemeyer | 238/84 |
| 4,150,790 | 4/1979 | Potter | 238/85 |
| 5,055,350 | 10/1991 | Neefe | 238/85 |
| 5,104,039 | 4/1992 | Oestmann | 238/106 |
| 5,367,007 | 11/1994 | Richards | 524/59 |

FOREIGN PATENT DOCUMENTS

| | | | |
|---|---|---|---|
| 154259 | 9/1985 | European Pat. Off. | 238/84 |

*Primary Examiner*—S. Joseph Morano
*Attorney, Agent, or Firm*—Donald E. Hewson

[57] ABSTRACT

A composite railway tie, and process for manufacture thereof, is disclosed. The composite railway tie comprises a main body portion being made of a first composite material comprising a binding constituent in a proportion of about 10% to about 20% by volume, and an aggregate material in a proportion of about 80% to about 90% by volume. The binding constituent comprises a plastic material chosen from the group of polyethylene and a polyethylene blend having at least 10% polyethylene. The aggregate material is in the form of irregular multi-faceted pieces chosen from the group consisting of crushed furnace slag, crushed gravel, crushed limestone, crushed granite, crushed basalt, and crushed trap rock, and mixtures thereof. The pieces of the aggregate material are distributed and otherwise arranged within the main body portion of the second material so that opposed surfaces of the pieces of the aggregate material have at least partial contact, one with another, in a contiguous manner. In essence, the binding constituent (preferably polyethylene) holds the aggregate material together in this interlocked fashion, so as to provide for a strong railway tie. An inner strengthening core, made from a material having high tensile strength, may also be included within the railway tie.

15 Claims, 12 Drawing Sheets

COMPOSITE RAILWAY TIE AND METHOD OF MANUFACTURE THEREOF

FIELD OF THE INVENTION

This invention relates to railway ties, more specifically composite railway ties, and a process for forming such railway ties.

BACKGROUND OF THE INVENTION

In North America and in most civilized and developing countries of the world, rail transportation of both freight cars and passenger cars, is an important part of each country's economic infrastructure. This is especially true in heavily urban areas in North America and Europe, and also in large geographical areas such as the United States and Canada. Most cities in developed countries of the world contain hundreds, if not thousands, of miles of railway track. Indeed, a large and developed country, such as the United States, might contain several hundred thousand miles of railway track, including main lines, marshalling yards, commuter lines, and so on.

Most types of railway tracks are supported on a plurality of individual ties spaced one from another along the length of the railway track. The ties are typically about two and one-half meters long and about fifteen to twenty centimeters in width and length. The rails are secured to the ties in any one of a variety of ways, such as by means of large spikes, or by means of specially designed clips engaging co-operating clip receiving members embedded in the ties. The ties keep the rails spaced apart at a predetermined distance. The ties are further designed to carry the static and dynamic loads of freight and passenger trains travelling at various speeds, including relatively high speeds, perhaps well in excess of one hundred miles per hour. Such ties include wood ties pressure impregnated with a preservative such as creosote, concrete ties and steel ties.

The most common type of railway tie is a conventional wood tie. Wood railway ties are the preferred railway ties in North America, for instance, since they can stand climatic change, and are relatively low cost to purchase and initially install, again compared to other types of railway ties.

Such conventional wood railway ties a have several disadvantages associated with them. Firstly, they are obtained by cutting down trees, which is generally considered environmentally undesirable. Considering the number of miles of railway lines there are in North America, for instance, a staggering number of wood railway ties must be used each year. Indeed, recent statistics indicate that twelve million wood railway ties were installed in North America in 1993, which number appears typical of the past few years. These twelve million wood ties were taken from hardwood trees such as oak and hard maple. An average of only three eight-foot long ties are available from a mature hardwood tree. Accordingly, over a five year period, for instance, about 20 million hardwood trees would need to be cut down to serve the railroad industry in North America alone. If this number is translated to use throughout the world, the number of trees that must be cut down over a five year period could be in the order of 100 million, which is a unacceptably high number and certainly has a severe impact on the environment. In these days of environmental consciousness, it is highly undesirable to continue to use wood ties.

Further, wood ties need to be replaced every few years, and thus tend to be somewhat expensive over a long period of time. The typical service life of a wood railway tie on a North American railway line is about ten years before the railway tie must be removed and replaced with a new tie. Considering the number of railway ties replaced in North America each year, and considering all developed countries in the world where railway ties are used, and therefore replaced, the number of railway ties replaced per year is absolutely staggering, thus leading to higher long term costs.

In use, wood railway ties are supported and somewhat surrounded by a compacted granular bed known as ballast. The ties tend to shift in the ballast bed, due to the extreme dynamic loading on the railroad track by a passing train. Wood railway ties therefore require routine maintenance in order to ensure that they are properly supporting the railway track rails. Also, the ballast bed requires consistent and regular maintenance in order to keep the individual pieces of ballast in place.

Also, the preservatives that are used to treat wood railway ties in order to protect the wood railway ties from insects, rotting, and so on, are typically made from hazardous chemicals, such as creosote, which is a known carcinogen. It is therefore undesirable to manufacture such railway ties, to have such railway ties in the environment during use, and also generally unacceptable to dispose of old used railway ties because of the impact on the environment.

Concrete railway ties are popular in Europe, and in other places in the world, where the availability of hardwood is limited. Concrete railway ties do have problems associated with them, however. Firstly, they are relatively expensive and can crack or spall over a number of years when used in areas of dramatic climatic change. Most significantly, they can suffer from rail to tie erosion under the heavier rolling stock loads in North America as compared to the lighter and smaller locomotives and passenger and freight cars used in Europe.

Steel railway ties realize limited use in North America and other parts of the world. Susceptibility to rust and a high noise level during use, which is unacceptable on passenger trains, limits their acceptability.

It is an object of the present invention to provide a railway tie that can be produced and used with little or no negative enviromnental impact.

It is another object of the present invention to provide an improved railway tie that lasts significantly longer than conventional wood railway ties.

It is yet another object of the present invention to provide an improved railway tie that costs less in terms of continuing maintenance.

It is still another object of the present invention to provide an improved railway tie that will not crack in cold weather.

It is a further object of the present invention to provide an improved railway tie that is suitable for use in virtually all types of railway lines.

It is yet a further object of the present invention to provide an improved railway tie that absorbs the noise of a train passing thereover.

SUMMARY OF THE INVENTION

In accordance with one aspect of the present invention, there is provided a composite railway tie, comprising a main body portion having a top surface, a bottom surface, first and second side surfaces, first and second end surfaces, and a first longitudinal axis oriented along the length of the tie. The main body portion is made of a first composite material comprising a binding constituent in a proportion of about 10% to about 20% by volume, and an aggregate material in a proportion of about 80% to about 90% by volume. The binding constituent in the main body portion comprises a plastic material chosen from the group of polyethylene and a polyethylene blend having at least 10% polyethylene. The aggregate material is in the form of irregular multi-faceted pieces chosen from the group consisting of crushed furnace slag, crushed gravel, crushed limestone, crushed granite, crushed basalt, and crushed trap rock, and mixtures thereof. The pieces of the aggregate material are distributed and otherwise arranged within the main body portion so that opposed surfaces of said pieces of aggregate material have at least partial contact, one with another, in a contiguous manner.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 5A:
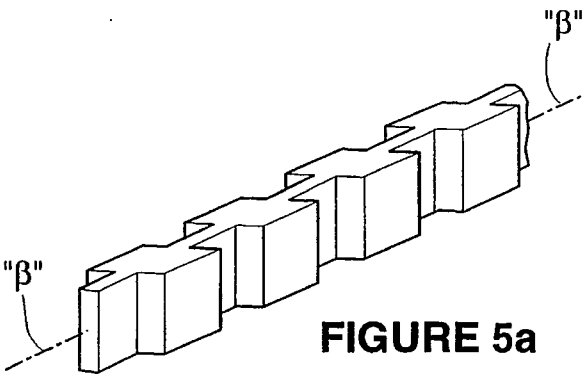
FIG. 5*a* is a perspective view showing an alternative embodiment inner strengthening core.

Reference will now be made to FIGS. 1 through 6, which show the composite railway tie 20 of the present invention installed in a railway track 22, and supporting two rails 24 and 26. A representative portion of ballast 28 is also shown. The composite railway tie 20 comprises a main body portion 30 having first longitudinal axis "α", a top surface 32, a bottom surface 34, a first side surface 36, a second side surface 38, a first-end-facing surface 40, and a second-end-facing surface 42. In the preferred embodiment, the top and bottom surfaces 32 and 34 are generally parallel one with the other; the first and second side surfaces 36 and 38 are also parallel one with the other, but also may be oriented or shaped otherwise, as will be discussed in greater detail subsequently, so as to preclude movement of the composite railway tie 20 in the direction of the first longitudinal axis "α", within the ballast. Further, the first and second end surfaces 40 and 42 are substantially parallel one to the other and substantially perpendicular to the top and bottom surfaces 32 and 34 and the first and second side surfaces 36 and 38, but also may be of an irregular shape or may be sloped.

The main body portion 30 of the first composite railway tie 20 is made of a first composite material, comprising a binding constituent in a proportion of about 10% to about 20% by volume and an aggregate material in a proportion of about 80% to about 90% by volume, with the two constituents adding up to 100%. The binding constituent in the main body portion 30 comprises a plastic material that is preferably polyethylene or a polyethylene blend having at least 10% polyethylene. Preferably, the plastic material is substantially all, or at least mostly, virgin polyethylene so as to ensure that the strength properties of the material are predictable and, therefore, are sufficient. The binding constituent may also comprise a substantial proportion of recycled polyethylene—typically, polyethylene that has been collected through municipal recycling programs. It has been found that using only recycled polyethylene tends to create a composite railway tie 20 that is of slightly lesser strength, and is certainly of a less predictable strength, than a composite railway tie 20 having the binding constituent of the first composite material being virgin polyethylene only. Indeed, it is preferred that there be at least 20% virgin polyethylene in the plastic material of the binding constituent of said first composite material. Part of the reason for this limitation of the proportion of recycled plastic material is that post consumer plastics can include several types of plastics and also impurities, thus causing a degree of uncertainty as to the material properties of the resulting composite plastic material.

The aggregate material in the first composite material is in the form of irregular multifaceted pieces 44 of rock or material having similar properties thereto. The aggregate material may be chosen from a group of materials consisting of crushed furnace slag, crushed gravel, crushed limestone, crushed granite, crushed basalt, and crushed trap rock, or may comprise mixtures thereof. It is highly preferable that the material is crushed so as to create the necessary irregular multi-faceted pieces 44 that are necessary to give the main body portion 30 of the composite railway tie 20 its strength. The irregular multi-faceted pieces 44 abut one against the other so as to transmit forces therebetween. The "sharp" irregular faces of these multi-faceted pieces 44 of aggregate material help preclude the individual pieces 44 of aggregate material from slipping and generally moving one with respect to the other so that forces that are not perpendicular to two contacting surfaces may still be transmitted from one piece of aggregate material to the next without undue slippage.

The pieces 44 of aggregate material are distributed and otherwise arranged within the main body portion 30 so that opposed pieces 44 of the aggregate material have at least partial contact, one with another in a contiguous manner, so as to, in essence, provide a generally continuous force transmitting structure of high strength within the main body portion 30 of the composite railway tie 20. The aggregate material forms a force transmitting and, therefore, load bearing structure throughout the main body portion. The polyethylene plastic material binds the aggregate material together in this above stated arrangement so as to maintain its force transmitting characteristics and therefore maintain its overall structural strength.

It is important that the pieces 44 of aggregate material are of a size generally less than about 1.27 cm—or, in other words, all of the pieces of aggregate would pass through a screen having aperture size of 1.27 cm—and are larger than about 0.32 cm—or, in other words, the pieces of aggregate are shaped and dimensioned so as not to be passable through a 0.32 cm screen. It is important that the pieces 44 of aggregate material not be too large so as to avoid large gaps between the pieces of material, which large gaps would be filled with plastic material and thus be relatively weak and relatively soft and compressible. The composite railway tie 20 of the present invention might tend to fail at such a gap. It is highly desirable to keep the size of the pieces 44 of aggregate material above about 0.32 cm so as to preclude any fine material, such as sand, from being included therein. The inclusion of sand could potentially substantially weaken the composite railway tie 20. It has been found that, in order to have a relatively fully distribution of aggregate throughout the first composite material, the pieces 44 of the aggregate material should be distributed in size such that about 100% of the pieces 44 are shaped and dimensioned so as to be passable through a 1.27 cm screen, about 30% of the pieces 44 are shaped and dimensioned so as to be passable through a 0.93 cm screen, about 2% of the pieces 44 are shaped and dimensioned so as to be passable through a 0.63 cm screen, and substantially none of the pieces 44 are shaped and dimensioned so as to be passable through a 0.32 cm screen. Such a distribution ensures that all of the pieces 44 of aggregate material are generally less than about 1.27 cm in size and are greater than about 0.32 cm in size, and are also distributed in size so as to preclude any relatively large voids between the pieces 44 of aggregate material when in place in the first composite material.

Figures 2A, 2B, 2C:
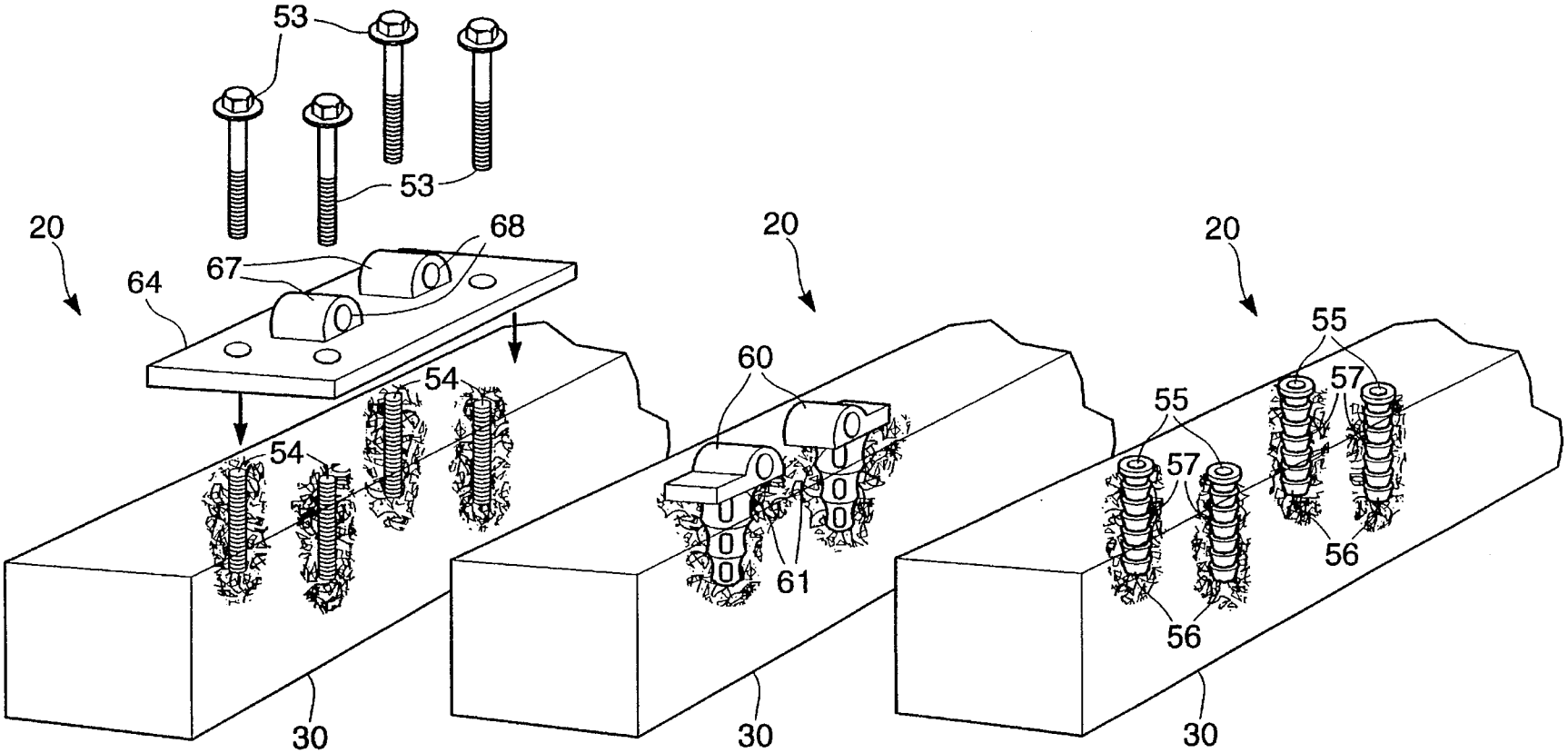
FIG. 2*a* is a perspective view of an end portion of the railway tie of FIG. 1, showing four fastener receiving apertures.
FIG. 2*b* is a perspective view of an end portion of the railway tie of FIG. 1, showing two fastener receiving elements retained within two co-operating fastener receiving apertures.
FIG. 2*c* is a perspective view of an end portion of the railway tie of FIG. 1 showing four fastener receiving elements retained within four co-operating fastener receiving apertures.

In order to fasten the rails 24 and 26 to the composite railway tie 20 of the present invention, it is possible to use various types of fastening means. One such type of fastening means, as shown in FIG. 2*a*, is in the form of large threaded coach bolts 53 with the fastener receiving apertures 54 for receiving such coach bolts 53, being co-operatively threaded. Preferably, a receiving plate 64 is retained in place by the threaded coach bolts 53. Extension portions 67 have apertures 68 therein, which apertures 68 are shaped and dimensioned to securely receive conventional "C" clips or "E" clips therein. It is also possible, as shown in FIG. 2*c*, to have the fastener receiving apertures 55 disposed within a corresponding fastener receiving element 56, and with each fastener receiving element 56 being securely retained within the main body portion 30 of the composite railway tie 20 so as to dispose the fastener receiving aperture 55 at the exterior of the composite railway tie 20. Each fastener receiving aperture 55 is internally threaded so as to receive a co-operating threaded coach bolt (not shown). The fastener receiving elements 56 have a plurality of angled steps 57 at the exterior thereof to preclude the fastener receiving element 56 from being removed from the composite railway tie 20. Further, the fastener receiving element could be in the form of a conventional Pandrol type fastener 60, as shown in FIG. 2*b*, which eyelet type fastener 60 is shaped and dimensioned to receive a conventional "C" clip (not shown) or a conventional "E" clip (not shown) within apertures 61 and engage the base flanges of the rails 24 and 26 of the railroad track 28. Such Pandrol type fasteners and "C" clips and "E" clips are manufactured by Pandrol Inc., of Bridgeport, N.J., U.S.A.

Figure 3:
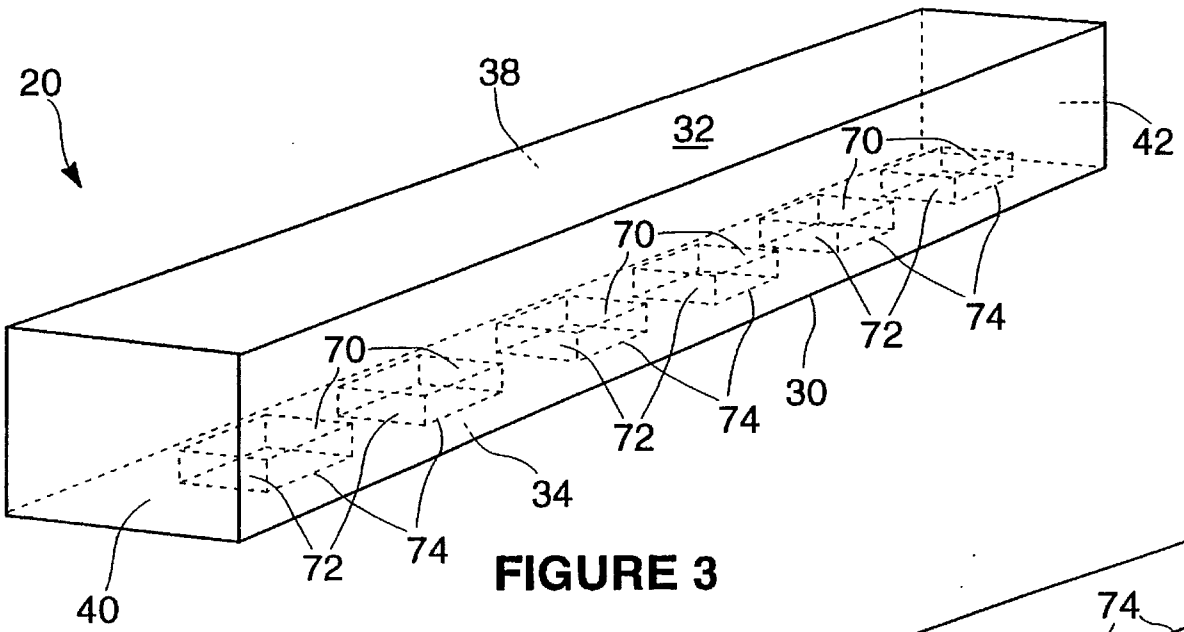
FIG. 3 is a perspective view of the composite railway tie of FIG. 1 having a plurality of ballast-receiving indentations formed in the bottom surface thereof.
Figure 4:
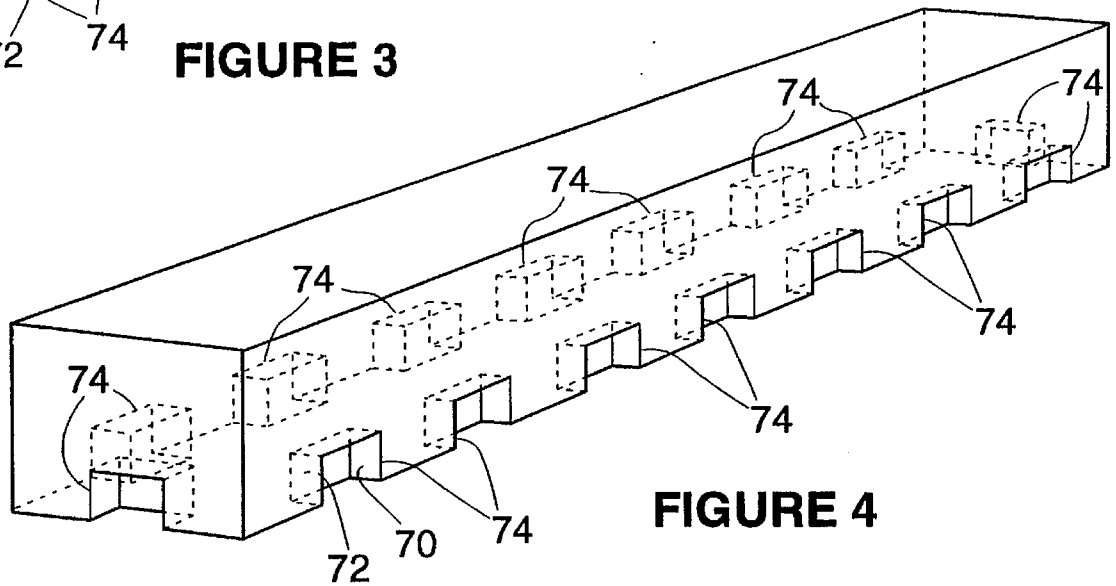
FIG. 4 is a perspective view of the composite railway tie of FIG. 1 having a plurality of ballast-receiving indentations formed in the first and second side surfaces and the first and second end surfaces thereof.

In the preferred embodiment, the composite railway tie 20 of the present invention further comprises at least one first-end-facing surface 70 formed in either the bottom surface 34, the first side surface 36, or the second side surface 38. Such a first-end-facing surface 70 would be oriented so as to face toward the first end surface 40 of the tie 20. Further, the composite railway tie 20 of the present invention further comprises at least one second-end-facing surface 72 formed in at least one of the bottom surface 34, the first side surface 36, or the second side surface 38. The second-end-facing surface 72 faces toward the second end surface 42 of the composite railway tie 20. In the preferred embodiment, there is a plurality of such first-end-facing surfaces 70 and second-end-facing surfaces 72 in the bottom surface 34 of the main body portion 30 of the composite railway tie 20. Further, each first-end-facing surface 70 could be adjoined to a co-operating second-end-facing surface 72 so as to jointly define a ballast receiving indentation 74 formed in the bottom surface 34 of the main body portion 30. These ballast receiving indentations 74 are preferably rectangular in shape, as shown in FIG. 3, although may be chosen from a variety of shapes, and are shaped and dimensioned so as to receive the ballast 28 of the railway track 22 therein and thereby preclude shifting of the composite railway tie 20 along its first longitudinal axis"$\alpha$". The ballast receiving indentations 74 are preferably about 10 cm long by about 10 cm across and about 4 cm deep. In an alternative embodiment, ballast receiving indentation 74 may be formed in the first and second side surfaces 36 and 38 and the first and second end surfaces 40 and 42 of the main body portion 30, as shown in FIG. 4.

In an alternative embodiment, the composite railway tie 20 of the present invention further comprises at least one elongate inner strengthening core 80 having a second longitudinal axis "$\beta$". Preferably, there is only one elongate inner strengthening core, although there could be more than one, and the one elongate inner strengthening core 80 is oriented such that the second longitudinal axis "$\beta$" thereof is substantially parallel to the first longitudinal axis "α" of the main body portion. Further, the elongate inner strengthening core 80 is preferably just slightly shorter in length than the main body portion 30 of the composite railway tie so as to extend nearly the length of the main body portion 30 of the composite railway tie 20, but also to be completely covered by the main body portion 30 at its first and second end surfaces 40 and 42.

The elongate inner strengthening core 80 is made from a second material chosen from the group consisting of thermoplastic material, wood, laminated wood, bound carbon fibre material, bound glass fibre material, and mixtures thereof. The purpose of the elongate inner strengthening core 80 is to increase the load bearing strength of the railway tie 20, largely by increasing the tensile strength of the bottom portion of the composite railway tie 20. Preferably, the main body portion 30 comprises from about 50% to about 90% of the total volume of the composite railway tie 20, and the at least one inner elongate inner strengthening core 80 comprises from about 10% to about 50% of the total volume of the composite railway tie 20. The inner strengthening core 80 may be in the form of an "I" beam in cross-section, as shown in FIG. 5, or may be in the form of a modified "I" beam in cross-section (not shown), where the top flange of the modified "I" beam is narrower than the bottom flange thereof so as to permit fastening means, such that a bolt entered from the top surface 32 of the railway tie 20, can pass by the top flange and still enter into the bottom flange. The inner strengthening core may also be an inverted "T" in shape (not shown) as the flange at the bottom would withstand tensile forces.

The elongate inner strengthening core 80 may be made from a thermoplastic material such as polyethylene. In this case, a portion of the plastic material of the binding constituent of the first composite material would become heat and pressure bonded with the plastic material in the second material of the elongate inner strengthening core 80, so as to form a securely interlocked structural interface between the first composite material and the second material, to thereby form a single integral structure.

In another alternative embodiment, it is envisioned that the elongate inner strengthening core 80 could comprise a thermoplastic material, such as polyethylene or a polyethylene blend, having monofilament fibre material 82 blended therein, as can best be seen in FIG. 5. Such monofilament fibre material 82 may be a glass fibre material, or may be a more costly high strength material such as KEVLAR®. The addition of such a monofilament fibre material 82 into the second material of the elongate inner strengthening core provides for increased tensile strength of the inner strengthening core 80.

Figure 5:
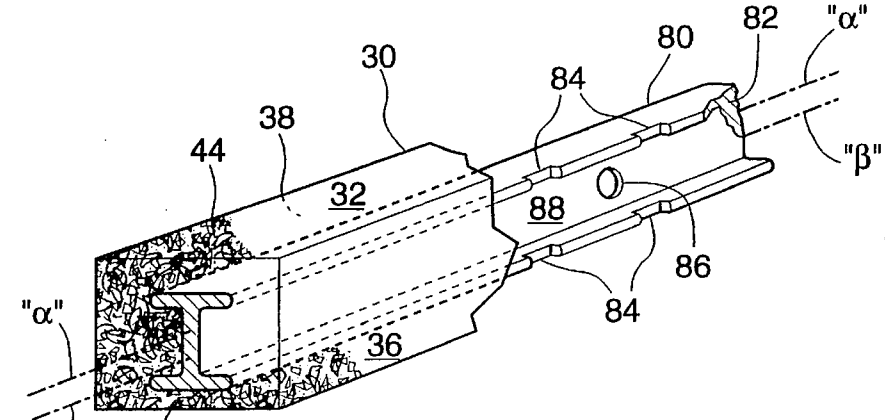
FIG. 5 is a perspective view of a portion of an alternative embodiment of the composite railway tie of the present invention.
Figure 1:
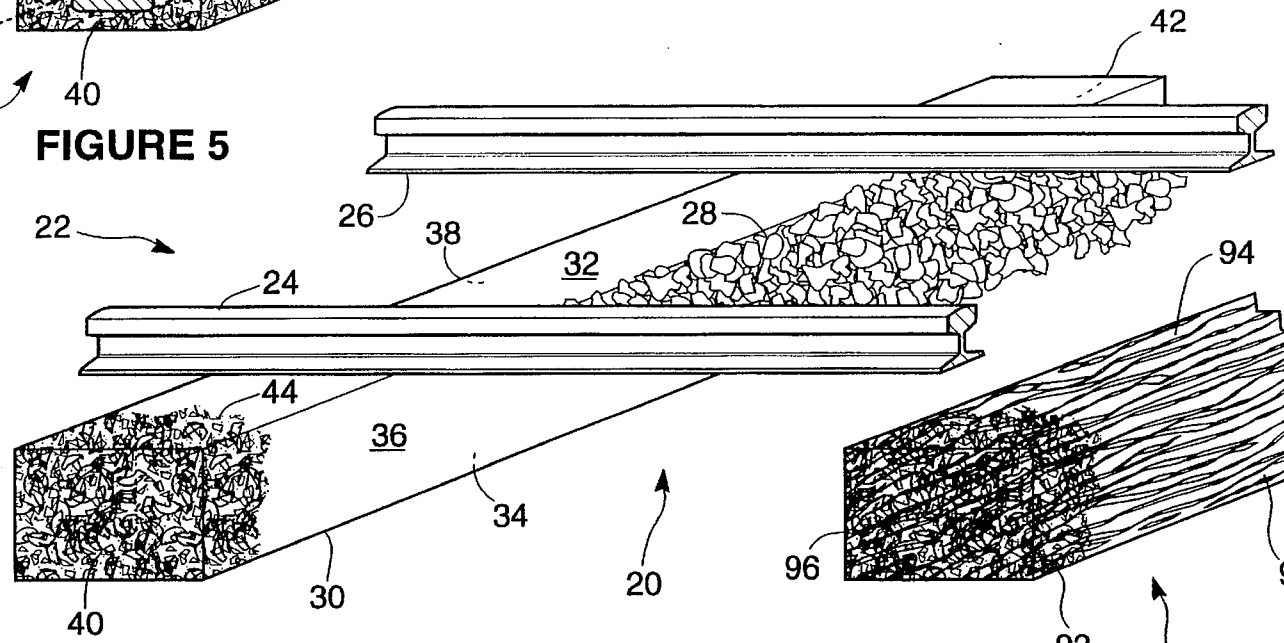
FIG. 1 is a perspective view of the composite railway tie of the present invention installed in a railway track.

In yet another alternative embodiment, the elongate inner strengthening core could have staggered outer surfaces, as shown in FIG. 5*a*, so as to preclude movement of the inner strengthening core in the direction of its second longitudinal axis "β", within the main body portion. Such movement might unwantedly occur during the formation of the composite railway tie. As can be seen in FIG. 5, the staggered outer surfaces can also be in the form of indentations 84 in the top and bottom flanges of the inner strengthening core 80, or may be in the form of an aperture 86 within the central portion 88 of the inner strengthening core 80.

Figure 6:
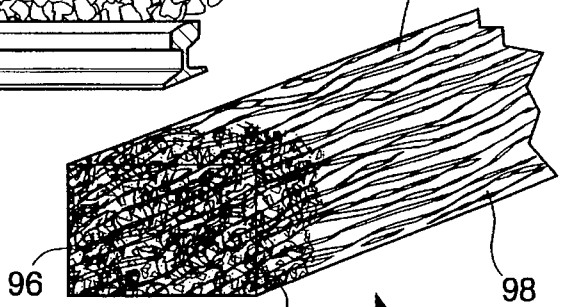
FIG. 6 is a perspective view of a portion of another alternative embodiment of the composite railway tie of the present invention.

In a further alternative embodiment of the composite railway tie 90 of the present invention, as shown in FIG. 6, it is envisioned that the first composite material of the main body portion 92 could comprise a binding constituent 94 in a proportion of about 10% to about 20% by volume, an aggregate material 96 in a proportion of about 80% to about 90% by volume, and strands of high tensile strength fibre material 98 in a proportion of about 0% to about 10% by volume. Such strands of high tensile strength fibre material 98 would increase the overall tensile strength of the main body portion 92 of the composite railway tie 90, and also would increase the stiffness of the composite railway tie 90 so as to preclude unwanted deflection that might occur during the support of extremely heavy loads. Such strands of high tensile strength fibre material might be a glass fibre material or a more costly material such as KEVLAR®.

In the preferred embodiment, the monofilament fibre material in the main body portion 30 and in the elongate inner strengthening core 80 are as long as possible, and are preferably continuous along the entire length of the main body portion 30 and the inner strengthening core 80, as may be the case, so as to provide for maximum tensile strength.

The composite railway tie 20 of the present invention is extremely strong and stable under repeated freezing and thawing conditions, will not chip or crack, and is resistant to moisture, oil, greases, and solvents.

Figure 7:
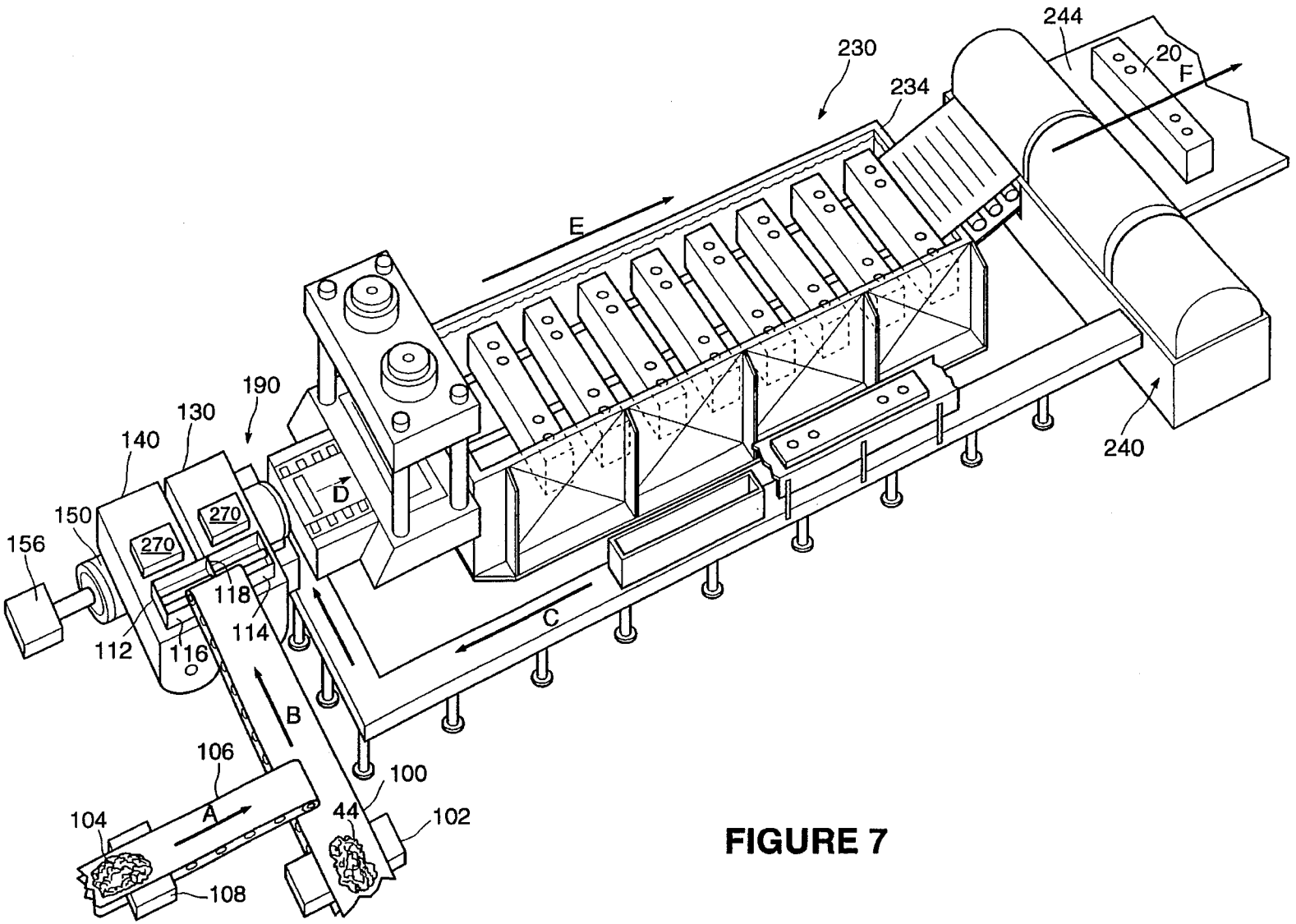
FIG. 7 is an overall perspective view of the equipment used to manufacture the composite railway tie of the present invention.
Figure 8:
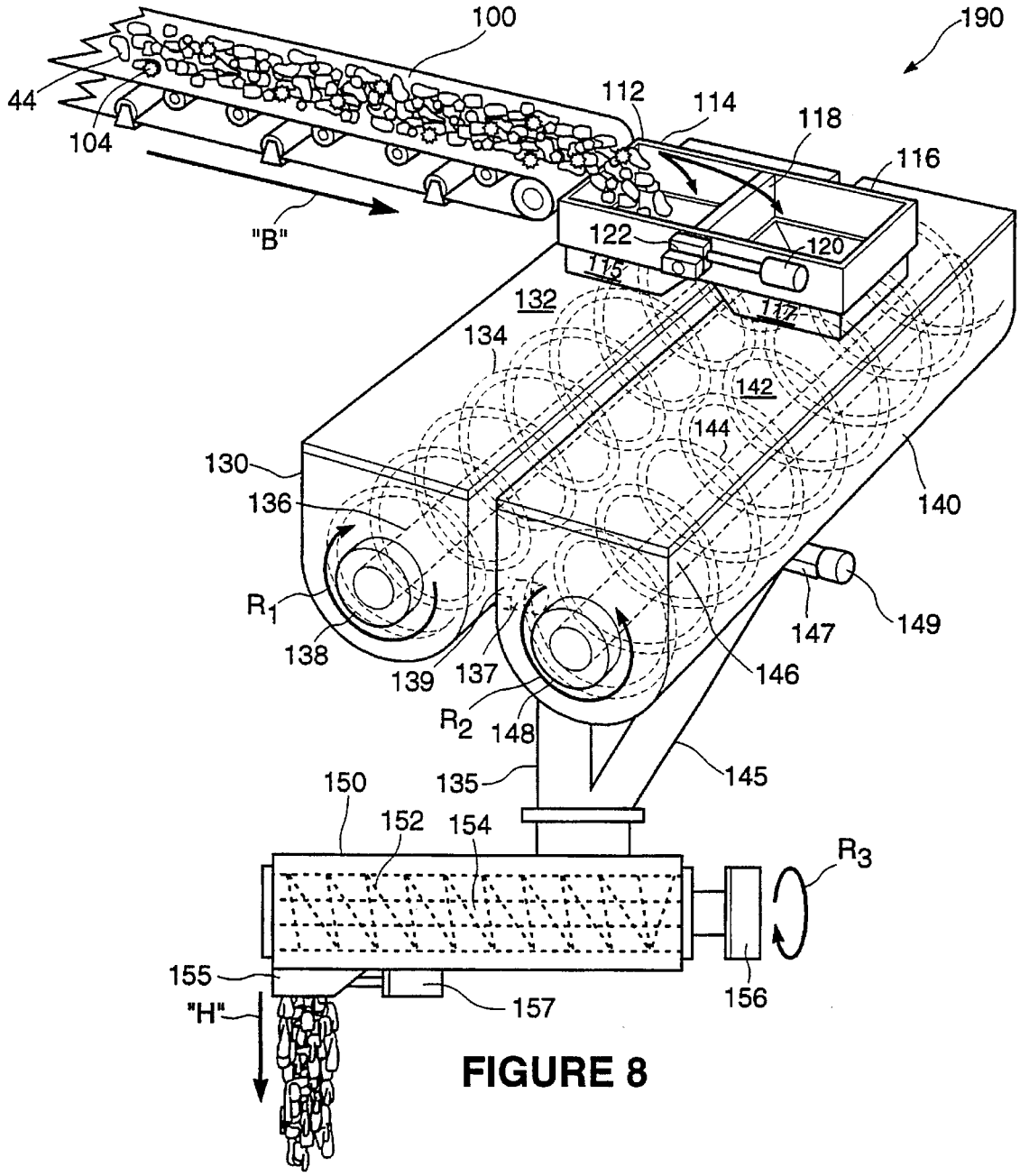
FIG. 8 is an enlarged perspective view of a portion of the manufacturing equipment of FIG. 7, showing twin heated blending drums and the thermal processor.

Reference will now be made to FIGS. 7 through 15, which show the process by which the railway tie of the present invention is manufactured, with FIG. 7 being an overall view of the entire process and FIGS. 8 through 15 showing various specific portions of the process.

The pieces 44 of aggregate material are introduced an aggregate feedstock belt 100, which aggregate feedstock belt 100 carries the pieces 44 of aggregate material from a hopper (not shown) and deposits the pieces 44 of aggregate material into blending drums 130 and 140, as will be discussed in greater detail subsequently. The aggregate feedstock belt 100 passes over an aggregate batch weighing system 102, which aggregate batch system 102 weighs the aggregate material as it passes thereover on the aggregate feedstock belt 100. The polyethylene plastic material 104 is introduced on a plastic feedstock belt 106, which moves the polyethylene plastic material in a direction as indicated by arrow "A", over a plastic batch weighing system 108. The polyethylene plastic material 104 is deposited onto the aggregate feedstock belt 100 so as to be present with the pieces 44 of aggregate material. Together, the pieces 44 of aggregate material and the plastic feedstock 104 travel along the aggregate feedstock belt 100, in a direction as indicated by arrow "B", as can best be seen in FIGS. 7 and 8, into a receiving hopper 112.

The aggregate batch weighing system 102 and the plastic feedstock batch weighing system 108 are calibrated so as to permit a certain weight of the respective of the aggregate material and the plastic feedstock material to pass thereover during a predetermined amount of time. The aggregate conveyor belt 100 and the plastic feedstock conveyor belt 106 are calibrated to transport the respective material at a predetermined rate so as to provide as closely as possible the proper ratio of each material. The aggregate batch weighing system 102 and the plastic feedstock batch weighing system 108 control the movement of the respective conveyor belts 100 and 104 so as to ensure the correct ratio of the aggregate material and the plastic feedstock material. This assumes that a relatively constant amount of aggregate material or plastic feedstock material is on the respective conveyor belt 100 and 104, per unit length of the respective conveyor belt 100 and 104.

In order to determine the relative amounts of the binding constituent and the aggregate material that are to be deposited onto the respective conveyors, the densities of each of the bindings constituent—the polyethylene plastic feedstock material—and the aggregate material are determined. This allows the binding constituent and the aggregate material to be weighed to correctly apportion the amounts thereof based on their determined densities.

The receiving hopper 112 has two tandem receiving compartments, a first receiving compartment 114 and a second receiving compartment 116. A moveable gate 118 separates the first and second receiving compartments 114 and 116 one from the other. The gate 118 is angularly moveable by way of a control motor 120 and gear box 122 arrangement between a first position where the aggregate material 44 and the plastic feedstock material 104 are channelled into the first receiving compartment 114 and a second position whereat the aggregate material and the plastic feedstock material are channelled into the second receiving compartment 116. Each of the first and second receiving compartments 114 and 116 has a respective gate 115 and 117 in the bottom thereof, with each gate 115 and 117 being selectively openable and closeable by way of a control motor arrangement (not shown).

The first receiving compartment 114 is located above a first heated blending drum 130, and is in fluid communication with the interior 132 of the first heated blending drum when the gate 115 of the first receiving compartment 114 is open. Similarly, the second receiving compartment 116 is located above a second heated blending drum 140, and is in fluid communication with the interior 142 of the second heated blending drum 140 when the gate 117 of the second receiving compartment 116 is open. In use, an amount of material from the aggregate feedstock belt 100 is routed by the gate 118 in the receiving hopper 112 into the first receiving compartment 114. The gate 115 in the bottom of the first receiving compartment 114 is open so as to permit the aggregate material 44 and plastic feedstock material 104 to enter into the interior 132 of the first heated blending drum 130. A spiral shaped vane member 134 within the first heated blending drum 130 is rotated by a rotating drive shaft 136 in a direction as indicated by arrow "$R_1$", as powered by a robust electric motor 138. A preferred rotational speed is between about ten r.p.m and about thirty r.p.m. When a desired amount of aggregate material 44 and plastic feedstock material 104 has been delivered into the first heated blending drum 130, the gate 118 of the receiving hopper 112 is moved so as to channel the aggregate material 44 and the plastic feedstock material 104 into the second receiving compartment 116 of the receiving hopper 112 and through the gate 117 of the second receiving compartment 116 and into the interior 142 of the second heated blending drum 140. The second heated blending drum 140 also has a spiral shaped vane member 144 therein connected to drive shaft 146 for rotation in a direction as indicated by arrow "$R_2$" as powered by a robust electric motor 148. The exact shape of the vane members 134 and 144 in the first and second heated blending drums 130 and 140, and the direction of rotation of the vane members, is not germane to the invention, and can be determined through routine engineering, as heated blending drums are readily available from various sources.

Typically, in use, after the first heated blending drum 130 has received a desired amount of aggregate material 44 and plastic feedstock material 104, the vane member 134 rotates so as to mix the aggregate material 44 and the plastic feedstock material 104 while the first heated blending drum 130 also heats the plastic feedstock material, which acts as a binding constituent in the final composite railway tie 20, and the aggregate material 44 at a temperature of about 130° C. until a relatively uniform mixture is achieved. It has been found that a temperature of 130° C. is sufficiently high to evaporate any moisture within the first and second heated blending drums 130 and 140. This relatively uniform mixture is the first composite material. While the binding constituent 104 and the aggregate material 44 are being heated and blended in the first heated blending drum 130, aggregate material and plastic feedstock material is being channelled into the second heated blending drum. After the first composite material in the first heated blending drum 130 has been thoroughly heated and blended, it is discharged from the first heated blending drum through a discharge chute 135, as controlled by a discharge gate 137 under the control of a control motor 139. After the first heated blending drum 130 has been emptied, and after a desired amount of aggregate material and plastic feedstock material has been deposited in the second heated blending drum 140, the gate 118 of the receiving hopper 112 is moved so as to channel the aggregate material and the plastic feedstock material again into the second receiving compartment 116 of the receiving hopper 112 and, ultimately, into the first heated blending drum 130, until a desired amount of aggregate material and plastic feedstock material has been deposited into the interior of the first heated blending drum 130. Concurrently, the vane member 144 of the second heated blending drum 140 in rotated by its electric motor 148 so as to heat and blend the binding constituent and the aggregate material at a temperature of about 130° C. until a relatively uniform mixture of the first composite material is achieved. After the relatively uniform mixture of the first composite material is achieved within the second heated blending drum 140, the mixture may be discharged from the second heated blending drum 140 through a discharge chute 145, as regulated by a discharge gate 147, under the control of a control motor 149, in a manner analogous to the first heated blending drum 130. In this manner, the first heated blending drum 130 and the second heated blending drum 140 work in tandem so as to permit the materials to be processed on a continuous basis, thereby maximizing the amount of material that can be processed in a given time.

From the discharge chutes 135 and 145, the first composite material is discharged into a thermal processor 150, which thermal processor 150 heats the first composite material until its temperature stabilizes at a temperature of between about 195° C. to about 225° C. A vane member 152 within the thermal processor 150 is connected to a central drive shaft 154 and is driven by a robust electric motor 156 in a direction as indicated by arrow "$R_3$". The first composite material is moved along the length of the thermal processor 150 to a discharge gate 155 at one end thereof. The discharge gate 155 is controlled by a control motor 157, which control motor permits a selected amount of first composite material to be discharge from the thermal processor 150 as a stream of material that falls into a mold base 162, as indicated by arrow "H" in FIGS. 8 and. 11.

Figure 9:
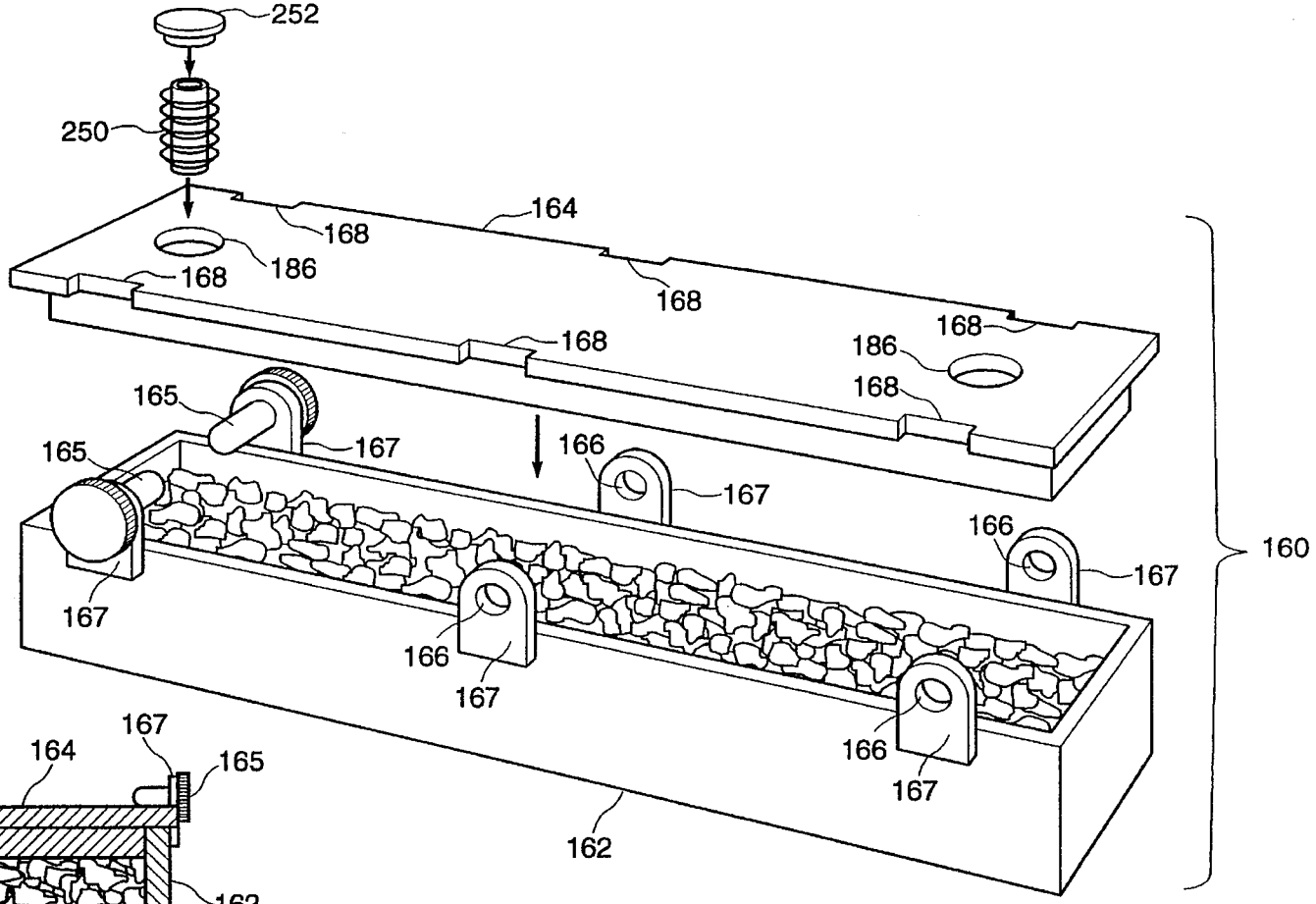
FIG. 9 is a perspective view of a portion of the manufacturing equipment of FIG. 7, showing a mold base and a mold cap.
Figure 10:
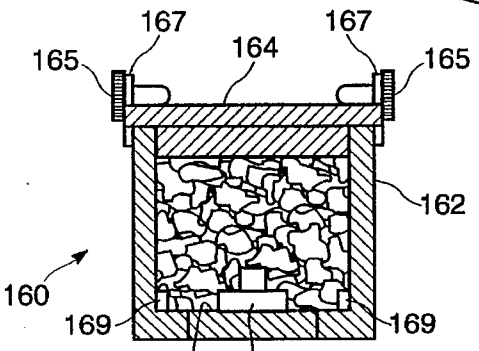
FIG. 10 is sectional end view of a portion of the manufacturing equipment of FIG. 7, showing the mold with the mold base in place on the mold cap.
Figure 12:
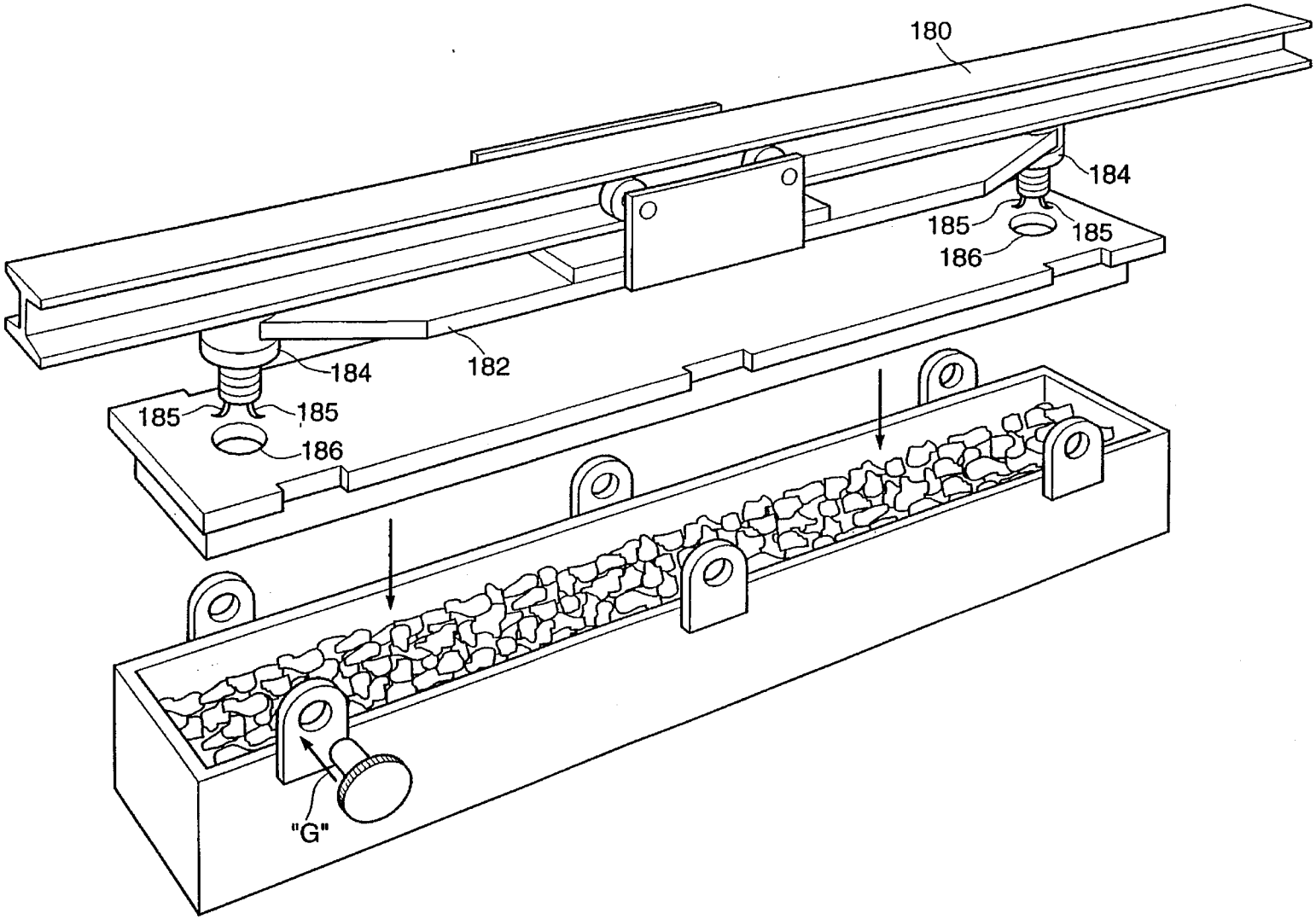
FIG. 12 is an enlarged perspective view of a portion of the manufacturing equipment of FIG. 7, showing the mold filled with a first composite material and with the mold cap being put in place on the mold by a trolley system.

The mold base 162 is part of a shell mold 160, as can best be seen in FIGS. 9, 10, and 12. The shell mold comprises the mold base 162 and a mold cap 164 that fits over the mold base 162. The mold cap 164 is retained in place by way of captive locking bolts 165 inserted through co-operating apertures 166 in lugs 167, which lugs 167 project upwardly from the mold base 162. A plurality of notches 168 in the mold cap 164 are shaped to receive the lugs 167 therein, so as to permit the accurate register of the mold cap 164 with the mold base 162.

The stream of first composite material is deposited into the mold base 162 so as to initially form the main body portion of the composite railway tie 20. In order to evenly distribute the first composite material in the mold base 162, the mold base 162 is moved back and forth along its length underneath the discharge gate of the thermal processor 150, and indicated by arrows "I" and "J" in FIG. 11. The mold base 162 is moved back and forth by way of a shuttle carriage 170 supported in moveable relation on a support frame 171. The shuttle carriage 170 has two pair of flanged wheels 172, which flanged wheels 172 engage support frame rails 173 securely retained in spaced apart relation by support frame cross members 174. The drive mechanism that moves the shuttle carriage 170 back and forth along the support frame rails 173 comprises a rodless cylinder 175 having a piston 176 movably retained therein, which piston 176 is moved by way of compressed air as controlled by first and second control valves 177 and 178. The piston 176 is attached to the shuttle carriage 170 by way of a connecting rod (not shown), which connecting rod projects through an elongate slot 179 in the rodless cylinder, which elongate slot 179 is sealed so as to prevent the escape of the compressed air from the rodless cylinder 175.

Figure 11:
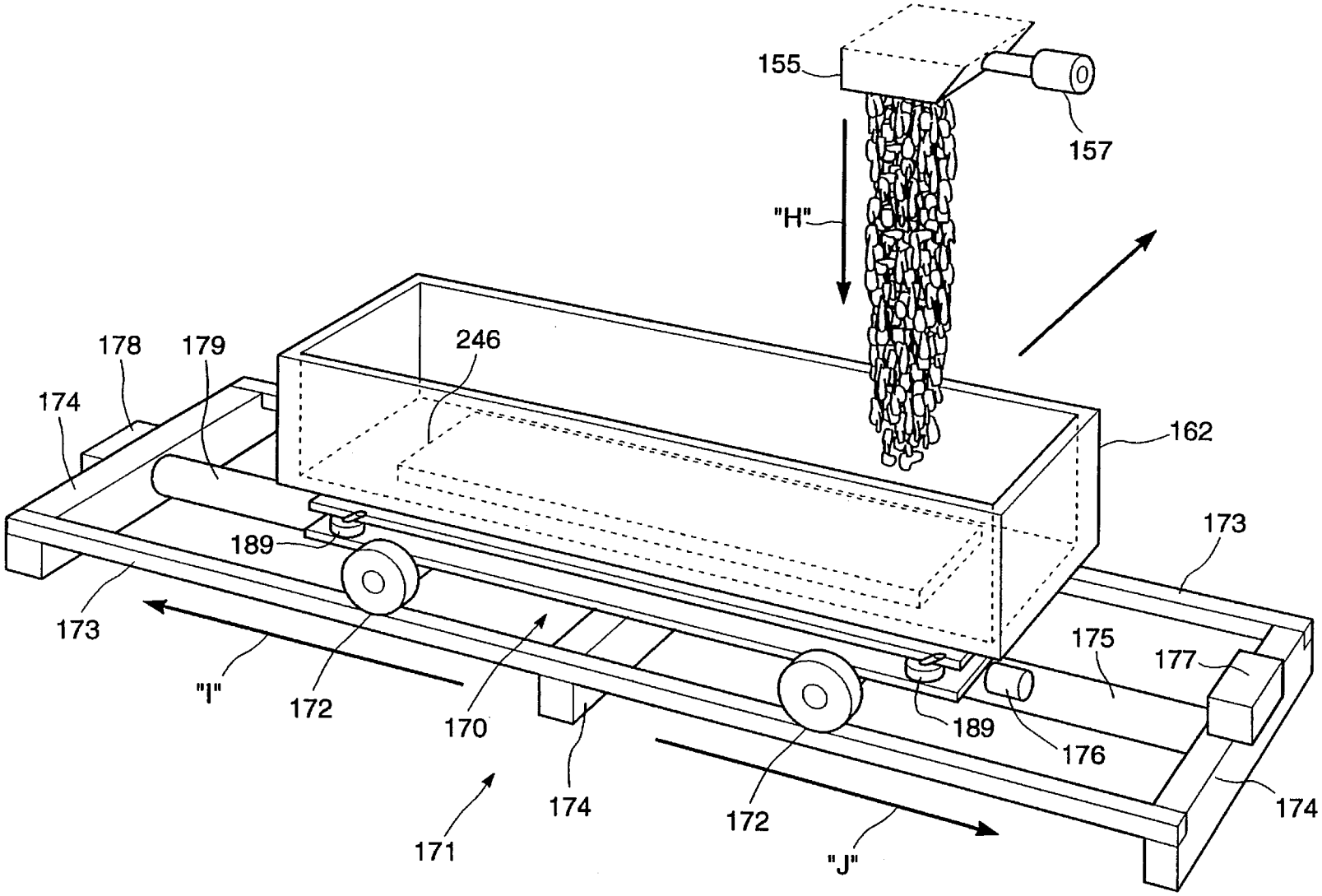
FIG. 11 is an enlarged perspective of a portion of the manufacturing equipment of FIG. 7, showing the first composite material being deposited into a moveable mold.

The mold base 162 is filled with the first composite material until a certain weight is reached, which weight is determined by weighing load cells 189, as can best be seen in FIG. 11. The weighing load cells 189 are operatively connected to the discharge gate 155 of the thermal processor 150. When the correct weight of material has been entered into the mold base 162, the discharge gate 155 is closed so as to stop the stream of first composite material therefrom. The correct weight of material for a composite railway tie 20 is predetermined and depends on the size of the composite railway tie, the densities and ratios of the particular aggregate material and plastic material, and monofilament fibre material if included, and also on the size and density of the elongate inner strengthening core 80 if included.

After the mold base 162 has been filled with the first composite material, the mold cap 164 is placed onto the mold base 162 so as to thereby close the mold 160, as can best be seen in FIG. 12. The mold cap is secured onto the mold base 162 by way of the captive locking bolts 165 inserted through the apertures in the co-operating lugs 167. Typically, the captive locking bolts 165 are pushed through the respective apertures 166 by a hydraulic or pneumatic piston arrangement (not shown).

The mold cap is carried over top of the mold base 162 by way of a trolley member operatively mounted on monorail 180, as can best be seen in FIG. 12. The trolley member has a mounting plate 182 attached thereto, which mounting plate 182 retains a pair of dual action air cylinders 184 thereon. The air cylinders 184 each operate a pair of bifurcated prong members 185 depending therefrom, which prong members 185 fit through tooling ports 186 in the mold cap 164. When a pair prong members 185 is extended through the respective tooling port 186, the two prong member 185 separate one from the other so as to be broader across at their ends than the diameter of the tooling port 186. In this manner, the mold cap 164 can be engaged and lifted by the prong member 185. In use, the mold cap 164 being carried over the respective mold base 162 is lowered onto the mold base 162 by the air cylinders 184. The double action air cylinder 184 then retract the prong members 185 back through the tooling ports 186.

Figure 13:
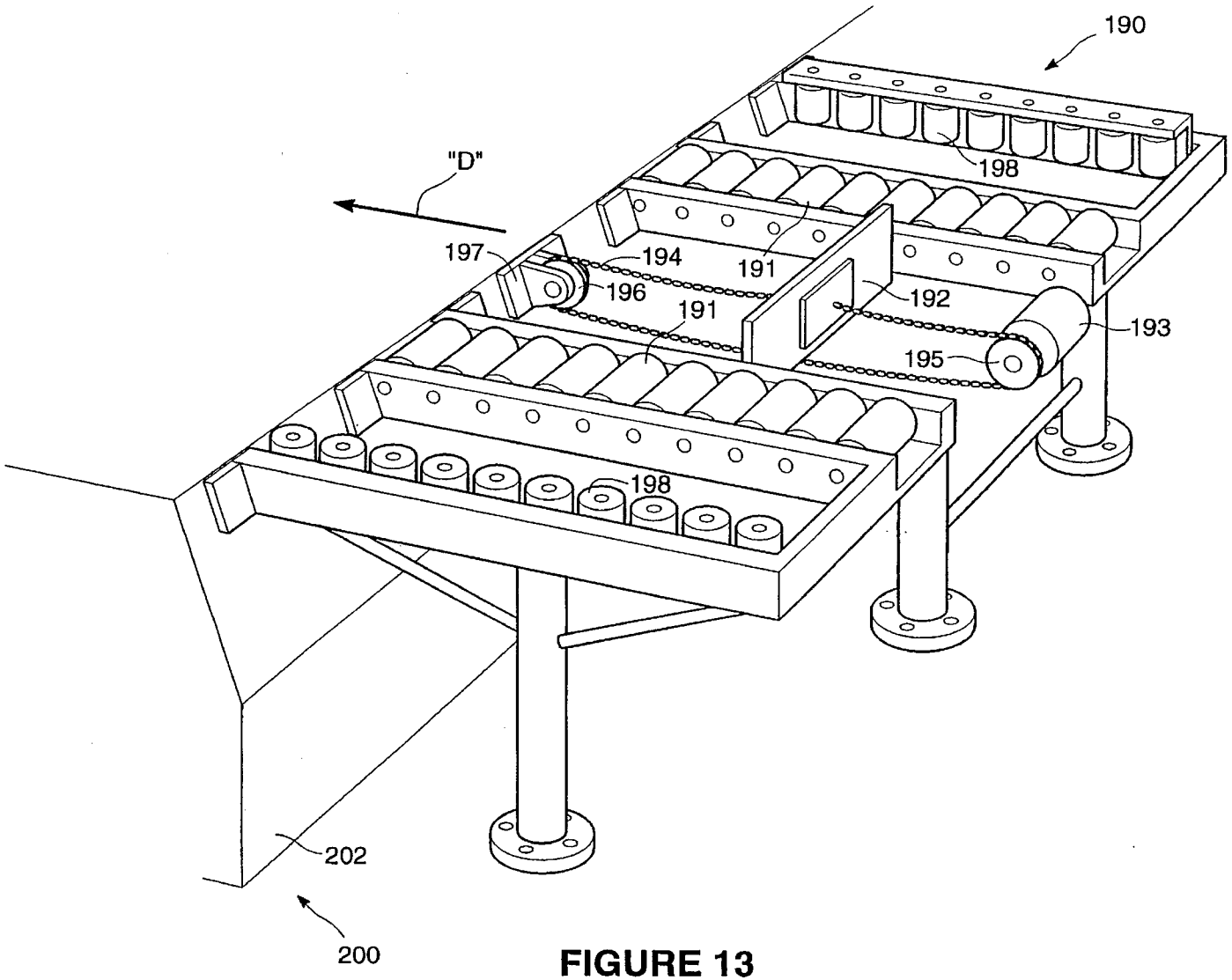
FIG. 13 is an enlarged perspective view of a portion of the manufacturing equipment of FIG. 7, showing a conveyor system for conveying molds into a mold press.

After the mold cap 164 has been secured in place on the mold base 162 as described above, the entire mold 160 is moved from the mold filling station 190 to a hydraulic press 200, as indicated by arrow "D" in FIGS. 7, 11, and 13. The mold 160 moves along a pair of mold support roller conveyors 191 and is moved by way of a pusher bar 192 powered by a reversing electric motor 193 connected to the pusher bar 192 by way of a drive chain 194 which engages a sprocket 195 on the motor 193 and also a return sprocket 196 that is secured to the lower frame member 202 of the hydraulic press 200 by way of a suitable mounting bracket 197. A pair of opposed side guide roller conveyors 198 keep the mold 160 laterally aligned as it is pushed from the mold filling station 190 to the hydraulic press 200 by the pusher bar 192. After the mold 160 is in place in the mold filling station 190, the electric motor 193 reverses so as to return the pusher bar 192 to a position close to the electric motor 193, so as to permit the next mold 160 to be entered into the mold filling station 190.

Figure 14:
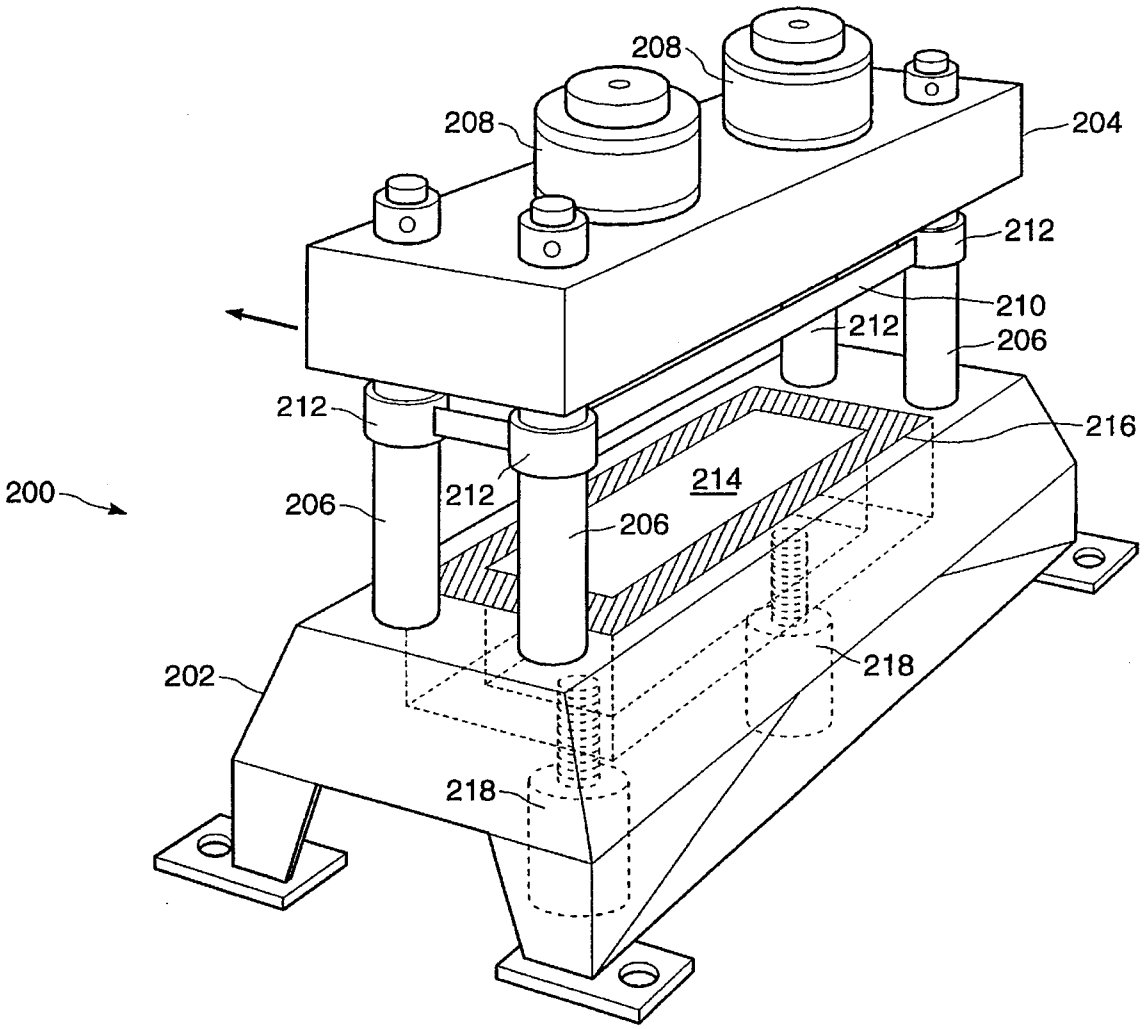
FIG. 14 is an enlarged perspective view of a portion of the manufacturing equipment of FIG. 7, showing the mold press.

Reference will now be made to FIG. 14, which shows the hydraulic press 200 that is used to apply pressure of about 6,400 kPa to the mold 160 in order to compress the first composite material, so as to thereby cause the binding constituent to be forcibly introduced to the entire exposed surface of each piece 44 of aggregate material, and to cause bonding of the molecules of the polyethylene plastic material of the first binding constituent into large polymer chains. Further, such compression tends to remove air pockets from the first composite material and tends to preclude air pockets from forming within the first composite material. The pressure of 6,400 kPa is applied at least until the outer surface of the first composite material has set so as to form the main body portion 30 of the composite railway tie 20. Due to the amount of heat energy retained within the aggregate material, the interior of the main body portion 30 will not cool quickly and, therefore, will not set quickly, especially under the pressure exerted by the hydraulic press 200. The hydraulic press 200 comprises a lower frame member 202, an upper frame member 204 vertically displaced from the lower frame member 202 by four tie bars 206. A pair of hydraulic cylinders 208 are located on top of the upper frame member 204 and are each operatively connected to a press head 210 by way of a respective piston arm (not shown). The press head 210 has a vertical guide 212 in each corner thereof, which vertical guides 212 slidably engage respective vertically disposed tie bars 206. A reinforced stationary receiving platform 214 is centrally disposed within the lower frame member 202, and is constructed and generally reinforced so as to support the mold 160 while the 6,400 kPa pressing force is being applied. A retractable bolster 216 is operatively retained by the lower frame member 202 for vertical movement by bolster operating cylinders 218 for vertical movement between a lowered position whereat the retractable bolster 216 is retainer within the lower frame member 202 and a raised position whereat the retractable bolster 216 extends upwardly above the top of the lower frame member 202 so as to permit the retractable bolster 216 to laterally bolster the mold base 162 during pressing.

Figure 15:
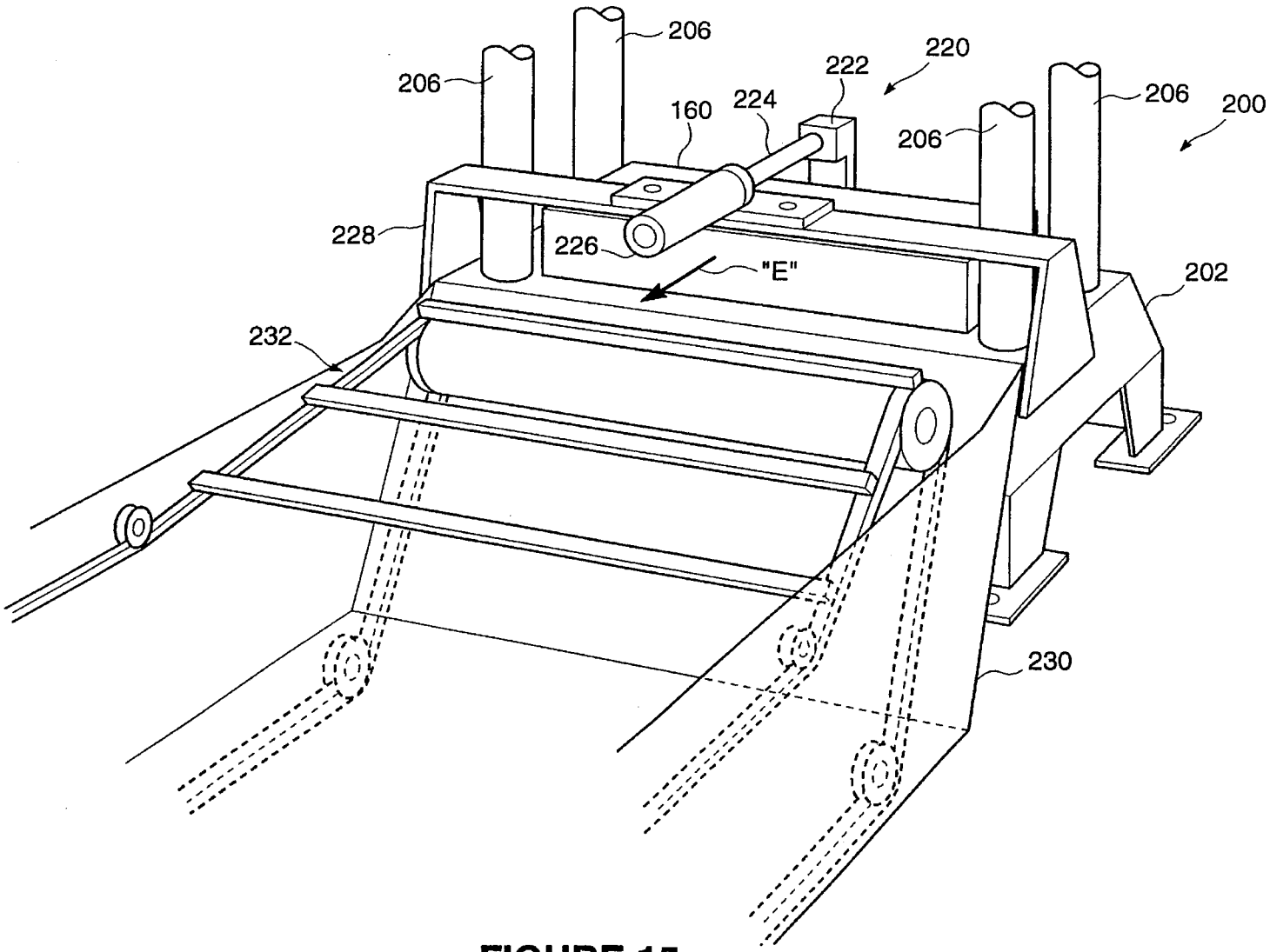
FIG. 15 is an enlarged perspective view of a portion of the manufacturing equipment of FIG. 7, showing an apparatus that removes the mold from an hydraulic press and shunts the mold into a cooling tank.
Figure 16:
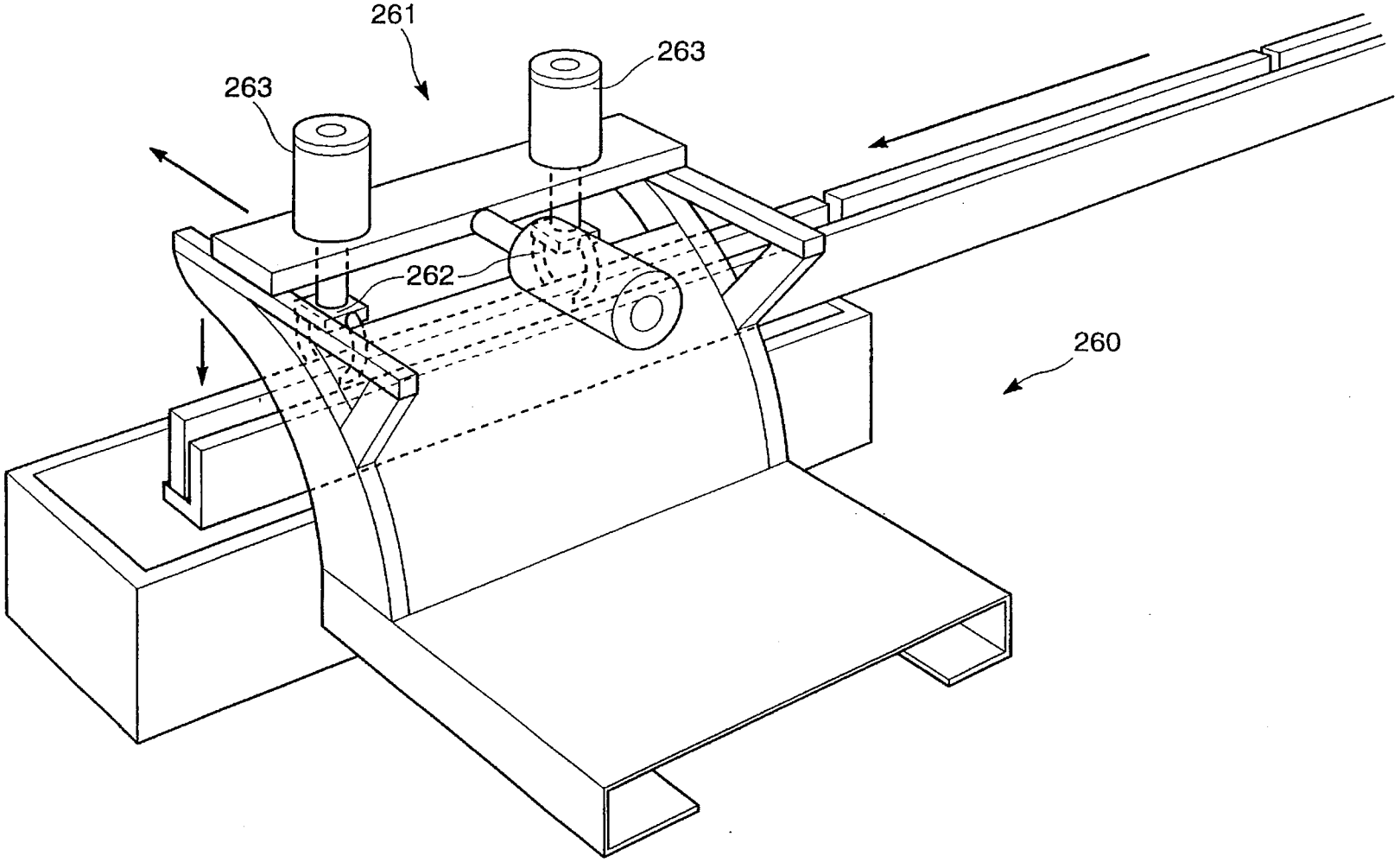
FIG. 16 is an enlarged perspective view of a portion of the manufacturing equipment of FIG. 7, showing the apparatus that places the inner strengthening cores in the mold.

In use, the closed mold 160 is moved onto the stationery receiving platform 214 of the lower frame member 202 as aforedescribed. Once the mold is in place on the stationery receiving surface, the retractable bolster 216 is raised by the cylinders 26 so as to surround the sides and ends of the mold 160, to thereby reinforce the mold 160 during pressing. Once the mold 160 has cooled sufficiently, at least until the outer surface of the first composite material has set, the hydraulic press 200 releases the pressure applied to the mold 160 and the retractable bolster 216 is retracted by the bolster operating cylinders 218 to its lowered position. The mold 160 can then be moved off the stationery receiving platform 214, as can be seen in FIG. 15, in the direction of arrow "E" by means of a removal mechanism 220. The removal mechanism 220 comprises a pivoting claw member 222 disposed on the end of a double acting pneumatically actuated piston arm 224 retained within a housing cylinder 226 secured to a frame member 228. The piston arm 224 is selectively movable between a first position whereat the claw member 222 first engages the mold 160 within the hydraulic press 200, as specifically depicted in FIG. 15, and a second position whereat the mold 200 is entered into a cooling tank 230. The claw member 222 is extended to its first position after the next mold 160 has completed its pressing cycle in the hydraulic press 200.

The cooling tank 230 contains a bath of water or other cooling liquid, which permits substantial cooling of each of the composite railway ties. In the preferred embodiment, the molds remain within the cooling tank 230 for about twenty to thirty minutes. The molds 160 are moved along the length of the cooling tank 230 by way of a filled-mold conveyor 232. At the exit end 234 of the cooling tank 230 a pneumatic or hydraulic piston apparatus (not shown) removes the captive locking bolts 165 from the respective apertures 166 in the lugs 167 of the mold base 162. The mold cap 164 can then be lifted off the mold base 162 by way of the dual action air cylinders 184 lowering the prong members 185 to the tooling ports 186 in the mold cap 164, inserting the prong members 185 into the tooling ports 186 so as to cause the prong members 185 to spread, thereby engaging the walls defining the respective of the tooling ports 186, thus permitting the prongs to grasp the mold cap 164. The dual action air cylinders 184 then retract the prong member 185 so as to lift the mold cap 164 from the mold base 162. The mold caps 164 are then ready to be replaced on the respective mold bases 162 at the mold filling station 190, as described previously.

In order to remove the composite railway tie 20 from the mold base 162, a mold stripping system 240, a plurality of suction cups (not shown)—in the preferred embodiment, four—are lowered onto the top surface 32 of the composite railway tie 20 and are raised upwardly by way of pneumatic or hydraulic pistons (not shown) so as to permit lifting of the composite railway tie 20 from the mold base 162. This is possible partially because the composite railway tie 20 shrinks slightly as it cools. The composite railway tie 20 is then dropped onto a removal conveyor 244 and is removed from the mold stripping system 240 in the direction as indicated by "F" in FIG. 7.

As can best be seen in FIG. 11, the mold 160 has a vertically moveable bottom in the form of a floating ejector plate 246. The floating ejector plate 246 can be pushed upwardly by hydraulic or pneumatic actuators (not shown) in order to remove the composite railway tie 20 from the mold base 162, or to assist the suction cups (not shown) with the removal of the tie 20.

In order to form the composite railway tie 20 of the present invention having at least one fastener receiving aperture in the main body portion thereof, a corresponding number of insert members 250 are inserted into the mold, as can be seen in FIGS. 9 and 10, through the tooling ports after the mold base 162 has been filled and after the mold cap has been put in place. The insert members 250 may be engaged by the plugs 252 that fit within the tooling ports 186 so as to retain the insert members 250 in place during the pressing process. After the mold cap 164 is removed, as described above, the insert members 250 can be removed as appropriate. The insert members are shaped as appropriate, so as to form fastener receiving apertures of the desired size and shape, such as the threaded fastener receiving apertures 54, as shown in FIG. 2*c*.

If a fastener receiving element is to be retained in the composite railway tie 20, then the fastener receiving elements may be inserted into the first composite material within the mold 160, through the tooling ports 186, as described above. Again, plugs 252 that fit into the tooling ports 186 during pressing may engage the fastener receiving elements so as to retain the fastener receiving elements in proper place during the pressing operation. It may be necessary to use a mold cap that is several inches thick for certain types of fastener receiving elements that extend upwardly above the top surface of the composite railway tie, such as the fastener receiving elements 60 in FIG. 2*b*.

In order to form the alternative embodiment composite railway tie having an elongate inner strengthening core 80 therein, the mold used must have a mold base 162 having spacer means 161, as shown in FIG. 10, extending upwardly from the bottom of the mold. The spacer means 161 may be a permanently formed part of the bottom of the mold, or may be removably attached to the bottom of the mold so as to permit different sizes and shapes of spacer means 161 to be used. In the preferred embodiment, the spacer means 161 are about one-half inch in diameter and about one to two inches high so as to displace the inner strengthening core 80 above the bottom of the mold 160 during the molding process and to retain the inner strengthening core in its predetermined position in the composite railway tie 20. In the preferred embodiment, the inner strengthening core 80 is placed into the mold and retained in place by the spacer means 161 so as to be generally centrally located within the main body portion 30 of the composite railway tie 20, with respect to the cross-section of the main body portion 30.

The inner strengthening cores 80 are retrieved from a linear indexing magazine storage system 260 by a frame mounted gripping and extending system 261 comprised of two core grippers 262 and two hydraulic cylinders 263 having sufficient stroke and power to drive the inner strengthening core 80 to a landing on the spacer means 161.

The insertion process begins after an initial layer of first composite material is flowed into the bottom of the mold. The inner strengthening core 80, once in the landed position, is held in place momentarily whilst additional first composite material is flowed around it. Prior to complete submersion of the inner strengthening core 80 by the first composite material, the grippers 262 open, the cylinders 263 retract, and the indexing magazine storage system 260 positions an inner strengthening core 80 for the next insertion sequence.

In the embodiment of the present invention wherein the composite railway tie 20 has ballast receiving indentations 74 in the bottom surface thereof, the bottom surface 163 of the mold has a series of forms 169 extending upwardly therefrom, which forms 169 are the desired shape of the ballast receiving indentations 74. In this embodiment, the spacer means 161 extend upwardly from the forms 169 at the bottom of the mold so as to create apertures (not shown) beyond the ballast receiving indentations 74 in the main body portion 30. These apertures would extend all of the way to the inner strengthening core 80. Since it is desirable to have the inner strengthening core 80 covered completely by the first composite material, or at least as close as possible to completely covered, these apertures should be as small in diameter as possible, preferably no more than about one to two centimeters, and should number no more than about four. If it is desired, the apertures may be filled with suitable plugs (not shown), in order to ensure that the inner strengthening core 80 is completely covered.

In an alternative embodiment, it is possible to use spacer means 161 made of a polyethylene plastic material to retain the inner strengthening core 80 in spaced relation above the bottom surface 163 of the mold 160. Such polyethylene plastic spacer means 161 would be melted by the heat from the first aggregate material that is pored into the mold 160.

During the filling process, as it is preferable to first partially fill the mold base 162 with the first aggregate material, place the elongate inner strengthening core 80 in place on the spacer means 161, and then fill the remaining portion of the mold base 162 with an additional amount of the first composite material.

The elongate inner strengthening core 80 may be formed at the same location as the composite railway ties 20 of the present invention are formed, in conjunction with the composite railway ties 20, or may be formed off-site, as desired. The elongate inner strengthening cores 80 are preferably formed by way of pultrusion for purposes of cost effectiveness and maximum strength.

In the alternative embodiment composite railway tie of the present invention wherein an amount of monofilament fibre material is included in the first composite material, the monofilament fibre material is preferably added to the first composite material while in the first and second blending drums 130 and 140, by way of blowing the fibre material into the interior of the blending drums 130 and 140 using a blower 270, as can be seen in FIG. 7, or, alternatively, a separate hopper (not shown) and conveyor belt (not shown) arrangement is used, along with a separate batch weighing system (not shown), to feed the monofilament fibre material directly or indirectly into the receiving hopper 112 of the heated blending drums 130 and 140.

Other modifications and alterations may be used in the design and manufacture of the apparatus of the present invention without departing from the spirit and scope of the accompanying claims.

What is claimed is:

1. A composite railway tie, comprising:

a main body portion having a top surface, a bottom surface, first and second side surfaces, first and second ends, and a first longitudinal axis oriented along the length of said tie;

wherein said main body portion is made of a first composite material comprising a binding constituent in a proportion of about 10% to about 20% by volume, and an aggregate material in a proportion of about 80% to about 90% by volume;

wherein said binding constituent in said main body portion comprises a plastic material chosen from the group of polyethylene and a polyethylene blend having at least 10% polyethylene;

wherein said aggregate material is in the form of irregular multi-faceted pieces chosen from the group consisting of crushed furnace slag, crushed gravel, crushed limestone, crushed granite, crushed basalt, and crushed trap rock, and mixtures thereof; and wherein the pieces of said aggregate material are distributed and otherwise arranged within said main body portion so that opposed surfaces of said pieces of aggregate material have at least partial contact, one with another, in a contiguous manner.

2. The composite railway tie of claim 1, wherein said plastic material in said main body portion comprises substantially exclusively virgin polyethylene.

3. The composite railway tie of claim 1, wherein said plastic material in said main body portion comprises at least 20% of virgin polyethylene.

4. The composite railway tie of claim 1, wherein said pieces of said aggregate material are distributed in size such that about 100% of said pieces are shaped and dimensioned so as to be passable through a 1.27 cm screen, about 30% of said pieces are shaped and dimensioned so as to be passable through a 0.93 cm screen, about 2.0% of said pieces are shaped and dimensioned so as to be passable through a 0.63 cm screen, and substantially none of said pieces are shaped and dimensioned so as to be passable through a 0.32 cm screen.

5. The composite railway tie of claim 1, further comprising at least one elongate inner strengthening core having a second longitudinal axis and being made of a second material chosen from the group consisting of thermoplastic material, wood, laminated wood, bound carbon fibre material, bound glass fibre material, and mixtures thereof;

wherein said main body portion comprises from about 90% to about 50% of the total volume of said composite railway tie, and said at least one elongate inner strengthening core comprises from about 10% to about 50% of the total volume of said composite railway tie.

6. The composite railway tie of claim 5, wherein said at least one elongate inner strengthening core is made from a thermoplastic material, and wherein at least a portion of said plastic material of said binding constituent of said first composite material is heat and pressure bonded with said plastic material in said second material, so as to form a securely interlocked structural interface between said first composite material and said second material, to thereby form a single integral structure.

7. The composite railway tie of claim 6, wherein said elongate inner strengthening core comprises a thermoplastic material further having a monofilament fibre material therein.

8. The composite railway tie of claim 5, wherein said elongate inner strengthening core has a staggered outer surface so as to preclude movement of said inner strengthening core along said second longitudinal axis within said main body portion.

9. The composite railway tie of claim 1, wherein said main body portion has at least one fastener receiving aperture therein, and wherein each said at least one fastener receiving aperture is adapted to receive and retain a fastening member therein for fastening the rails of a railroad track thereto.

10. The composite railway tie of claim 9, wherein each said at least one fastener receiving aperture is disposed within a corresponding fastener receiving element, and each fastener receiving element is securely retained within said main body portion of said composite railway tie so as to dispose said fastener receiving aperture at the exterior of said composite railway tie.

11. The composite railway tie of claim 1, further comprising at least one first-end-facing surface formed in at least one of said bottom surface, said first side surface and second side surface so as to face toward said first end of said tie, and at least one second-end-facing surface formed in said at least one of said bottom surface, said first side surface and second side surface so as to face toward said second end of said composite railway tie.

12. The composite railway tie of claim 11, wherein each said at least one first-end-facing surface, and each said at least one second-end-facing surface, is located in said bottom surface of said composite railway tie.

13. The composite railway tie of claim 11, wherein each of said first-end-facing and second-end-facing surfaces jointly define a ballast-receiving indentation formed in said at least one of said bottom surface, said first side surface and second side surface of said composite railway tie.

14. The composite railway tie of claim 13, wherein each ballast receiving indentation is rectangular in shape.

15. A composite railway tie, comprising:

a main body portion having a top surface, a bottom surface, first and second side surfaces, first and second end surfaces, and a first longitudinal axis oriented along the length of said tie;

wherein said main body portion is made of a first composite material comprising a binding constituent in a proportion of about 10% to about 20% by volume, and an aggregate material in a proportion of about 80% to about 90% by volume, and strands of high tensile strength fibre material in a proportion of about 0% to about 10% by volume;

wherein said binding constituent in said main body portion comprises a plastic material chosen from the group of polyethylene and a polyethylene blend having at least 10% polyethylene;

wherein said aggregate material is in the form of irregular multi-faceted pieces chosen from the group consisting of crushed furnace slag, crushed gravel, crushed limestone, crushed granite, crushed basalt, and crushed trap rock, and mixtures thereof; and wherein the pieces of said aggregate material are distributed and otherwise arranged within said main body portion so that opposed surfaces of said pieces of aggregate material have at least partial, contact, one with another, in a contiguous manner.

* * * * *